US007144329B2

(12) United States Patent
Tamura

(10) Patent No.: US 7,144,329 B2
(45) Date of Patent: Dec. 5, 2006

(54) GOLF CLUB WITH WHICH GRAVITY RULE IS REALIZED

(76) Inventor: Kunihiro Tamura, 5-1-906, Kaminarimon 2-Chome, Taito-Ku, Tokyo (JP) 111-0034

( * ) Notice: Subject to any disclaimer, the term of this patent is extended or adjusted under 35 U.S.C. 154(b) by 0 days.

(21) Appl. No.: 10/928,065

(22) Filed: Aug. 27, 2004

(65) Prior Publication Data

US 2005/0026711 A1 Feb. 3, 2005

Related U.S. Application Data

(63) Continuation of application No. PCT/JP03/13956, filed on Oct. 30, 2003.

(30) Foreign Application Priority Data

Oct. 31, 2002 (JP) ..... 2002-317077
Aug. 15, 2003 (JP) ..... 2003-293747

(51) Int. Cl.
*A63B 69/36* (2006.01)

(52) U.S. Cl. ..... 473/223; 473/219; 473/234

(58) Field of Classification Search ..... 473/219, 473/221–226, 234, 422, 451, 453; 72/492, 72/493

See application file for complete search history.

(56) References Cited

U.S. PATENT DOCUMENTS 1,676,270 A * 7/1928 Mattison ..... 473/234
2,135,648 A * 11/1938 Stumpf ..... 473/233
3,136,553 A * 6/1964 Davis ..... 473/233
3,137,504 A * 6/1964 Zordan et al. ..... 473/457
3,215,437 A 11/1965 Webb
3,498,616 A 3/1970 Hurst
4,090,711 A 5/1978 Amato
4,325,549 A * 4/1982 Vasselli ..... 473/519
5,074,564 A 12/1991 Rilling
5,080,363 A 1/1992 Soong
5,082,283 A * 1/1992 Conley et al. ..... 473/234
5,133,551 A * 7/1992 Handy et al. ..... 473/567
5,259,620 A 11/1993 Marocco
5,524,892 A 6/1996 Karp
5,575,722 A 11/1996 Saia et al.
5,590,875 A * 1/1997 Young ..... 473/457
5,616,832 A 4/1997 Nauck
5,634,856 A * 6/1997 Rainey ..... 473/234
5,683,308 A 11/1997 Monette (Continued)

FOREIGN PATENT DOCUMENTS

JP 05-95573 U 12/1993

(Continued)

*Primary Examiner*—Nini F. Legesse
(74) *Attorney, Agent, or Firm*—Burr & Brown

(57) ABSTRACT

In order to stabilize golf swing motion of a player, downswing motion that is the most important but difficult part in golf swing is streamlined. A moving object is set in a golf club. When the club is in a vertical position in a flow of its movement from the top of the swing to downswing, the moving object starts to fall by the player's kinetic energy and gravity. The player swings down the club while confirming the fall of the moving object and matching his/her motion to the vector of the object in a direction of the fall. This enables the player to perform an efficient downswing where the club is swung in a shortcut path. A more realistic club swing can be made when it is performed on a address mat where a stance and a distance of a ball are indicated. This can be achieved by a removable handle end portion.

3 Claims, 3 Drawing Sheets

U.S. PATENT DOCUMENTS

| | | | | |
|---|---|---|---|---|
| 5,718,643 | A | 2/1998 | Wright et al. | |
| 5,984,795 | A | 11/1999 | Stafford | |
| 6,173,610 | B1 * | 1/2001 | Pace | 73/493 |
| 6,461,163 | B1 | 10/2002 | Gallagher et al. | |
| 6,500,074 | B1 | 12/2002 | Thacker | |
| 6,569,042 | B1 * | 5/2003 | LaChance et al. | 473/457 |
| 6,767,299 | B1 * | 7/2004 | Chang | 473/564 |

FOREIGN PATENT DOCUMENTS

| | | | |
|---|---|---|---|
| JP | 08-24386 | A1 | 1/1996 |
| JP | 11-057098 | A1 | 3/1999 |
| JP | 3059704 | U | 7/1999 |
| JP | 3065192 | U | 1/2000 |
| JP | 2000-317030 | A1 | 11/2000 |
| JP | 2001-321478 | A1 | 11/2001 |

* cited by examiner

GOLF CLUB WITH WHICH GRAVITY RULE IS REALIZED

CROSS REFERENCE TO RELATED APPLICATIONS

This application is a continuation of PCT/JP2003/013956 having an international filing date of Oct. 30, 2003, which designated the United States, the entirety of which is incorporated herein by reference.

This application also claims the benefit of Japanese Application No 2002-317077, filed Oct. 31, 2002, and Japanese Application No. 2003-293747, filed Aug. 15, 2003, the entireties of which are incorporated herein by reference.

FIELD OF THE INVENTION

The present invention relates to a golf club which, in a golf swing comprising forced motion, enables the secure performance of a down swing, which is the most important to projecting a golf ball toward the target objective of the golf swing.

BACKGROUND OF THE INVENTION

The golf swing is a series of movements, commencing with the back swing and continuing to the down swing.

In this movement, a pair of kinetic energy provided by the golfer and a part of potential energy obtained from the field of gravity when the arms and the club fall are transferred to the ball by swinging, according to the additive rule of force.

Because the energy transferred to the ball by the club head upon impact is determined by the physical properties of the club head and ball and the laws of physics, adequate control is difficult. Therefore, a technology which maximizes swing efficiency is desired.

As a measure for this, it is necessary to achieve the efficiency of the down swing, which is the most complex and difficult to understand among golf swings.

The conventional method is an ambiguous method, in which the down swing is performed by turning around at the top of the swing, and being conscious of the weight of the head of the golf club itself.

SUMMARY OF THE INVENTION

In the conventional method of being conscious of the head weight, because the timing of raising and lowering the club from the back swing to the down swing and the feeling of the club head weight relies upon an individual's sense, the down swing tends to have a large scatter, lacking stability.

Therefore, it is an objective of the present invention to remove such conventional shortcomings.

DETAILED DESCRIPTION OF THE INVENTION

Figure 1:
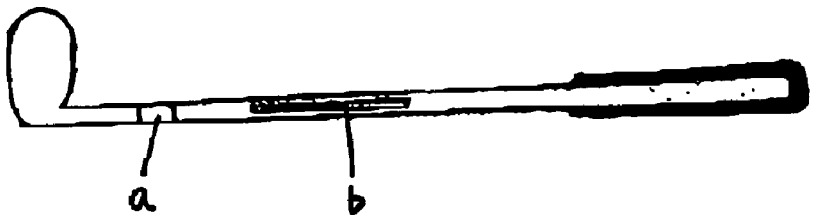
FIG. 1 is a golf club containing a gravity sensing bar according to the invention.
Figure 2:
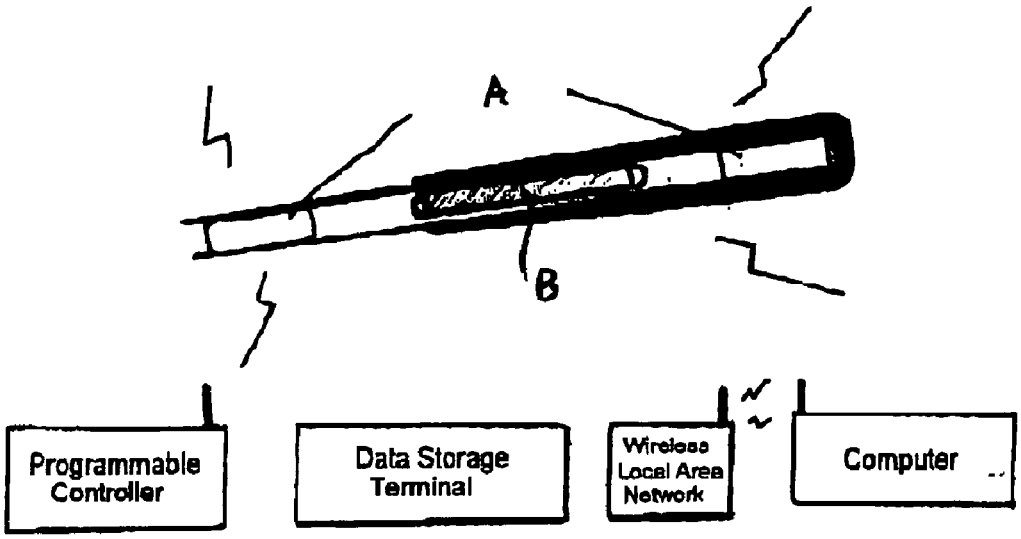
FIG. 2 is a conceptual drawing where data are taken into a programmable controller from a golf club according to the invention containing a bar with a sensor and a housing for data output, accumulated in a data storage terminal, sent to a computer via a wireless LAN, and detected.
Figure 3:
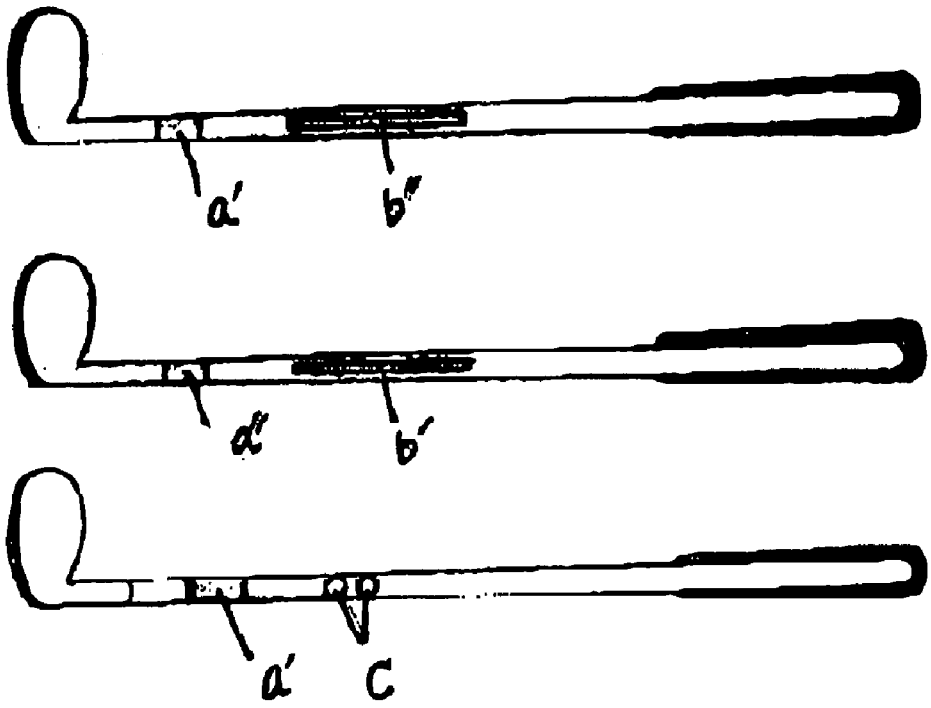
FIG. 3 contains three views of: a club with a magnetic stopper and a ferromagnetic moving bar, a club with a ferromagnetic stopper and a magnetic moving bar, and a club where the moving object is a ball.
Figure 4:
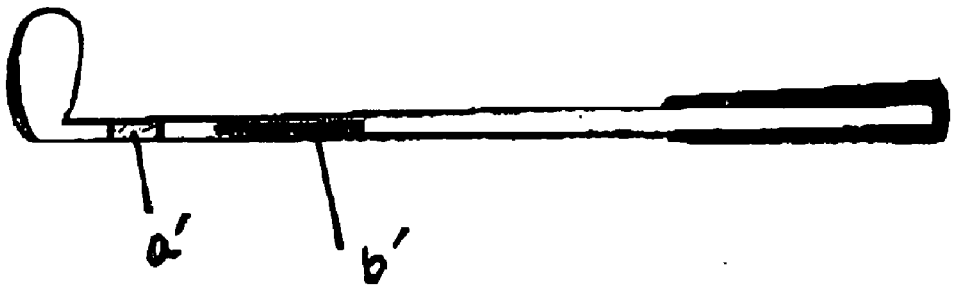
FIG. 4 is a golf club where a stopper and a moving object are magnetic and installed with the same poles facing with each other.
Figure 5:
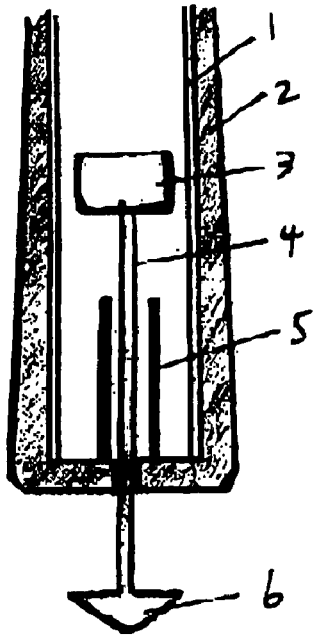
FIG. 5 is a golf club where a moving object is projected from the handle end.
Figure 6:
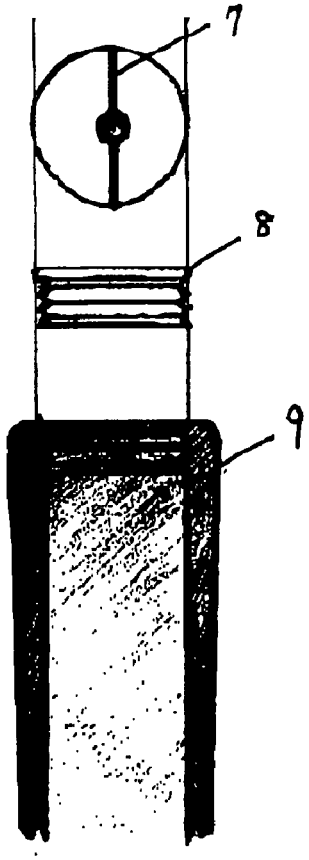
FIG. 6 is a golf club with a detachable handle where the handle end section opens/closes the shaft end section opening.

The present invention enables an abbreviated down swing by providing a gravity sensing bar, comprising a moving object embedded in a golf club, where the gravity sensing bar starts to fall by the force of gravity and by the golfer's kinetic energy from when the shaft is erected almost vertically, in which swinging is accomplished while being conscious of dropping both arms in front of the chest, in alignment with the direction of fall vector, and lowering the club shaft vertically.

The gravity sensing bar is adjusted for the swing of each golfer and the length, weight, raw material of the golf club used, and is inserted into the shaft, in which a stopper for receiving the gravity sensing bar is fixed close to the head within the shaft, and the gravity sensing bar is located at the stopper unit at the time of addressing. The bar falls vertically by the force of gravity when the shaft is standing in the series extending from the back swing to the down swing, swinging being performed in alignment with the vector in the direction of fall.

The gravity sensing bar is positioned on the head side of the golf club from the back swing to the top of the swing, and moves to the head side at the start of the down swing, and back to the head side of the club again after turning around.

The moving time of the sensing bar can be measured with a sensor, taken from the housing into a programmable controller and image processed with a computer, thereby achieving an efficient down swing while the player watches himself on a display.

The gravity sensing bar can be ferromagnetic, and provided in the shape of a bar or ball. The bar is adjusted in terms of its length and weight, and the ball is adjusted in terms of its diameter, weight, and number.

The moving object is attached to a stopper having magnetism on the head side at the time of addressing, when the shaft is standing, while turning around from the back swing to the down swing, and the moving object is adjusted of its own weight so that it starts falling by the golfer's kinetic energy and the force of gravity, and by swinging in alignment with the vector in the direction of fall, and an abbreviated, efficient down swing around the body can be performed, lowering the club shaft vertically.

Preferably one of the moving objects and the stopper contains a magnetic element, and the other a magnet-attachable element, or the construction may be reversed.

In another embodiment, the golf club has a moving object having magnetism and a stopper having magnetism, and these parts are fixed near the head within a carbon shaft (non-magnetizing shaft) with the same poles facing each other in a shaft generating magnetic repulsion to promote the movement of a moving object, which falls from the head side to the handle side when turning around from the back swing to the down swing, enabling the accomplishment of an efficient down swing in alignment with the vector in the direction of fall.

In another embodiment, the golf club includes a moving object located within the handle at the time of addressing, and the moving object is projected from the handle end by the golfer's kinetic energy and the force of gravity when the shaft is standing in a series of motions from the back swing to the down swing, and by performing a down swing directing the projection toward the golf ball, and an abbreviated, efficient down swing can be performed, lowering the club vertically.

In a golf club where the moving object consists of a composite body, its projection length is set to about 10 cm, and it is attached to the handle end section with its weight and balance being adjusted.

The golf club may have a detachable handle end, the handle end section of which is provided with a screw having a groove on top so that it can be easily removed with a coin, etc., formed so that the moving object can be easily replaced. A projecting means of the moving object from the handle end section can also be detached from the handle end section.

As another embodiment of the present invention, because swinging while conscious of the swing plane of each golf club is possible by standing on a mat on which desirable relative positions of the feet and ball are printed according to the height and the length of the golf club, addressing the foot positions being adjusted, and swinging while checking the ball position, practice can be effectively performed.

The present invention can be made compatible for all kinds of golf clubs, and can be comfortably used, not only with full-size clubs used for normal play, but also short clubs for various kinds of practice. Especially, by inserting a moving object into a practice swing using a shortened club, if swung while being conscious of the motion of the moving object at the down swing, a strong, full swing can be performed, even if the weight of the head section is small.

Therefore, in comparison with clubs in which no moving object is contained, the difference in swinging feel can be recognized. Especially, a swing with substantial feel can be performed by checking (being conscious of) the fall of the moving object and swinging fully so as to send the moving object toward the head side while turning around from the top of the swing to the down swing.

Swing practice with full-swing feel using the shortened golf club is most suitable for practice in which one is conscious of the pressure on the grip coming from maintaining the grip strength constant in order to prevent excess force from being applied to the grip in a series of swings, because the shaft is short and the club is light-weight overall.

Because the golf club of the present invention converts the down swing, which is the most important, complex, and difficult to understand among golf swings from the conventional ambiguous method having a conscious awareness of the head weight, into a method where a moving object is dropped from the head side by the golfer's kinetic energy and gravity and the club is vertically lowered in alignment with the vector in the direction of all, in order to easily enable an abbreviated, efficient swing, it leads to the basic construction of a golf swing, which can then lead to an expansion of the entire golf industry.

EXPLANATION OF REFERENCE NUMERALS AND LETTERS a Stopper
a' Magnetic stopper
a" Ferromagnetic stopper
b Gravity-sensing bar
b' Magnetic bar
b" Ferromagnetic bar
c Ball
A Housing
B Bar with a sensor
1 Shaft
2 Handle
3 Stopper
4 Bar
5 Guide pipe
6 Weight
7 Groove for detaching
8 Detaching screw cap
9 Handle

The invention claimed is:

1. A golf club enabling a down swing which allows a golfer to feel the force of gravity, comprising a shaft defined by a circumferentially closed sidewall surface, a head arranged at one end of the shaft, a stopper incorporated within the shaft near the head of the golf club, and a gravity-sensing bar positioned within the shaft and extending along the shaft so as to be freely movable along the length of the shaft by the force of gravity alone, wherein the gravity-sensing bar allows the golfer to become conscious of the feeling that the gravity-sensing bar is falling by the force of gravity at a timing immediately after the beginning of the down swing of the golfer, and wherein the gravity-sensing bar is provided with a sensor.

2. The golf club according to claim 1, wherein the shaft has a detachable grip end capable of opening and closing an end opening of the shaft.

3. A golf club enabling a down swing which allows a golfer to actually feel the force of gravity, comprising a shaft defined by a circumferentially closed sidewall surface, a head arranged at one end of the shaft, a stopper incorporated within the shaft near the head of the golf club, and a gravity-sensing bar inside the shaft so as to be freely movable along the length of the shaft by the force of gravity alone, wherein the gravity-sensing bar allows the golfer to become conscious of the feeling that the gravity-sensing bar is falling by the force of gravity when the shaft is standing in a series of actions from the back swing to the down swing of the golfer, wherein the gravity-sensing bar and the stopper are both magnetic and are positioned within the shaft such that like polarities are facing one another, and wherein the gravity-sensing bar is in contact with the stopper from the back swing to the top of the swing whereas the gravity-sensing bar separates from the stopper immediately at the start of the down swing by the force of gravity.

* * * * *